United States Patent [19]

Panken et al.

[11] 4,257,329

[45] Mar. 24, 1981

[54] FLUIDLESS MASTERS

[75] Inventors: Irving Panken; Robert S. Radow; Brian J. Briddell, all of Dayton, Ohio

[73] Assignee: The Mazer Corporation, Dayton, Ohio

[21] Appl. No.: 714,618

[22] Filed: Aug. 16, 1976

Related U.S. Application Data

[63] Continuation-in-part of Ser. No. 596,597, Jul. 17, 1975, abandoned.

[51] Int. Cl.[3] ..... B41M 5/02

[52] U.S. Cl. ..... 101/473; 101/335; 101/368; 427/144; 428/306; 428/914

[58] Field of Search ..... 428/914, 306; 101/473, 101/335, 368; 427/144

[56] References Cited

U.S. PATENT DOCUMENTS

| | | | |
|---|---|---|---|
| 2,199,265 | 4/1940 | Lohrey | 101/368 |
| 2,271,758 | 2/1942 | Champion | 101/473 |
| 2,320,769 | 6/1943 | Champion | 101/473 |
| 2,777,824 | 1/1957 | Leeds | 260/2.5 |
| 2,893,890 | 7/1959 | Harvey | 428/914 X |
| 2,989,493 | 6/1961 | Clark et al. | 428/514 |
| 3,019,201 | 1/1962 | Clancy et al. | 101/335 |
| 3,037,879 | 6/1962 | Newman et al. | 428/306 X |
| 3,037,879 | 6/1962 | Newman et al. | 117/36.1 |
| 3,101,668 | 8/1963 | Leeds | 101/401.1 |
| 3,244,550 | 4/1966 | Farnham et al. | 101/473 X |
| 3,287,153 | 11/1966 | Schwarz et al. | 117/36.1 |
| 3,330,791 | 7/1967 | Matex et al. | 260/28 |
| 3,336,244 | 8/1967 | Rockoff | 101/367 |
| 3,342,622 | 9/1967 | Croker | 197/172 X |
| 3,411,935 | 11/1968 | Winzer | 428/914 X |
| 3,413,184 | 11/1968 | Findlay et al. | 161/160 |
| 3,458,339 | 7/1969 | Newman | 101/468 X |
| 3,506,749 | 4/1970 | Weissman | 264/102 |
| 3,762,944 | 10/1973 | Sloan et al. | 101/473 |
| 3,962,526 | 6/1976 | Penken | 427/144 |
| 4,018,162 | 4/1977 | Sharky et al. | 101/473 |

*Primary Examiner*—Clyde I. Coughenour

*Attorney, Agent, or Firm*—Biebel, French & Nauman

[57] ABSTRACT

Preprinted duplicating masters for producing printed copies, with or without spirit duplicating fluids, comprising a foundation sheet reverse printed in a predetermined pattern with an imaging material which produces copies upon the application of pressure alone, although the spirit duplicating process can be used. The imaging material is applied as a synthetic polymeric resin dispersion having an ink composition therein and is subsequently heated to gel but not fuse the resin so that the ink composition will be retained therein but will be releasable and transferable in a predetermined pattern to a substrate by at least the application of pressure alone. A protective cover sheet is placed over the printing to prevent inadvertent and accidental transfer of the ink composition.

3 Claims, No Drawings

FLUIDLESS MASTERS

CROSS-REFERENCE TO RELATED APPLICATIONS

This is a continuation-in-part of application Ser. No. 596,597, filed July 17, 1975 now abandoned, the entire disclosure of which is incorporated by reference.

BACKGROUND OF THE INVENTION

This invention relates to preprinted duplicating masters for producing copies at least by the use of pressure alone.

With the ever increasing work load on teachers and instructors, it becomes important to use modern technology to relieve the teachers of some of the duties ordinarily undertaken. One tool of frequent use by educators is the spirit duplication process for producing copies of tests and instructional materials. Typically, the teacher makes a master copy or master which in turn is used to produce the plural copies.

The master is basically a sheet having reverse-printed thereon an ink composition which when contacted by a copy sheet having at least the surface wet with a solvent or spirit material will transfer a portion of that ink. Thus, plural copies of the master are made by bringing the sheets to be printed into contact with the reverse printed side of the master. U.S. Pat. Nos. 2,748,024 to Klinowski; 2,824,812 to Drautz; and 3,036,924 to Newman are examples of spirit duplicating ink compositions and printing processes.

Initially, the masters were individually made from a transfer sheet having a surface coating of a spirit duplicating material. Using a typewriter, for example, some of the material on the transfer sheet was transferred to a sheet overlying the transfer sheet by striking the overlay sheet and causing the ink to be crash printed on the overlay sheet.

It has been found that it is also possible to preprint masters with ink compositions of the spirit duplicating type. Then the teacher can use such preprinted masters to make copies for students on a given subject without having to compose the assignment itself. But the use of such preprinted masters still requires the use of fluid spirits. In addition, the costs involved in spirit duplicating because of the use of such fluids are higher than a transfer process which is capable of use without fluid.

Also of interest in the background of this invention are the plastic structures which have an ink material dispersed therein and will transfer some of that ink by the application of pressure. Such structures are formed as printing plates, hand stamps, ink rollers for printing processes, and the like, but as far as known have not been used in making preprinted duplicating masters. They generally comprise a synthetic plastic material and an inking material. The plastic acts as an adhesive resinous vehicle; a porous, microreticulated structure; or a binder and retains the inking material until it is exuded under pressure. The plastic structure is usually made by mixing the plastic with a solvent or plasticizer to form a paste, organosol, plastisol or the like and then shaping the plastic and curing by using heat. The inking material can be added to the plastic material before the shaping step or after the porous structure is formed. Examples of such processes and structures are U.S. Pat. Nos. 3,037,879, 3,359,900 and 3,458,339 to Newman; U.S. Pat. No. 3,436,234 to Terry et al; and U.S. Pat. Nos. 2,777,824; 3,055,297 and 3,101,668 to Leeds. Reference is also made to Champion U.S. Pat. No. 2,320,769.

SUMMARY OF THE INVENTION

The present invention provides a preprinted duplicating master which will produce printed copies with or without the use of spirit duplicating fluids. That is, the improved preprinted duplicating master of the invention can be used in the conventional spirit duplicating process to produce copies or the master can be used to make copies without employing spirits or solvents but by the use of pressure alone.

The amount of dye used in the ink of the masters of the present invention is less than normally used on spirit duplicating masters, and yet the number of copies obtained is nearly the same. In addition, because the masters are subject to a fluidless transfer, copy paper can be used which need not be of the grade necessary in spirit duplicating systems. That is, in a spirit duplicating process, there is a tendency for the solvent on the copy paper to carry the ink into and through the paper causing the image to blur and the ink to bleed through the copy paper. In certain grades of paper this is more noticeable than in others. A fluidless transfer process, however, does not have this difficulty.

Still further, the imaging material which is preprinted to form the master need not be specially formulated in the sense of being frangible and yet transferable.

The improved preprinted duplicating master of the invention is basically a foundation sheet reverse printed in a predetermined pattern with a synthetic resinous plastic composition having a releasable ink composition therein. The ink composition will be released or exuded from the resin and transferred in the predetermined pattern to another sheet or surface by the application of pressure alone or by the use of a solvent and pressure. A protective cover sheet may be superposed over the reverse printing to prevent inadvertent or accidental transfer of the ink composition prior to the actual use of the master.

The improved preprinted duplicating master is made by directly printing in a reverse pattern a mixture of a resin dispersion and an ink composition therein on a foundation sheet which may have already been printed on the other surface with instructional material, etc. The printing can be done as part of a continuous process or a batch, sheet-by-sheet basis. Next at least the printing is exposed to heat so that the resin dispersion will gel (but not fuse) and form a microporous resin structure—the reverse printing in a predetermined pattern—which will retain the ink composition while exuding it and transferring the printing when pressure and/or solvents are applied. Finally, the foundation material is cut or trimmed so as to make individual sheets, if necessary, and the protective cover material may be secured over the printing. In this form the sheets may be bound into a booklet of masters arranged, for example, by topic. In this way when the class reaches a point where a quiz, exam or particular work lesson is appropriate, the teacher need only extract the particular preprinted master from the booklet and prepare copies. Alternatively, the individual sheets may be placed in folders, envelopes, boxes, etc.

To use the master, the protective cover sheet is removed or the master removed from the envelope or folder and the printing on the master is brought into contact with a substrate to transfer in the predetermined printed pattern a portion of the releasable ink in the resin structure to the substrate. The transfer can be done by using uniform pressure to force the master and the substrate toward one another. The application of pressure causes the ink to exude from the resin structure. This permits use of the master to transfer to any type of receptive surface, i.e., fabric, leather, wood, etc., and not just a copy paper. Alternatively, a copy paper could have at least a surface wet with a solvent or "spirit" material which will dissolve a portion of the ink material and deposit it on the copy paper as in an ordinary spirit duplicating process.

Thus the present invention, an improved preprinted duplicating master as well as the method of making and using the master, allows for both dry and spirit duplication. When used in a spirit duplication process, the improved master will produce as many copies as one normally gets with presently available spirit duplicating masters. Significantly, the masters of the present invention produce usable copies immediately while in ordinary spirit duplication, the first few copies are usually too light to use. Using a pressure only, i.e., without fluid or spirits, the improved masters of the invention normally will produce in excess of 150 copies, which can be compared to the Newman dry process in U.S. Pat. No. 3,359,900, which produces only up to about 25 copies.

Additionally when the fluidless process is used, it is possible with the present masters to print both sides of a copy sheet. This is because the copy sheet is kept dry and the application to the reverse side is not defeated by requiring that a copy paper become wet with spirit material. In a spirit duplicating process the wetting would create problems prohibiting ready application of an image to the reverse side in a second pass.

It is, therefore, an object of the present invention to provide an improved preprinted duplicating master, as well as methods of making and using preprinted duplicating masters, which will produce copies by use of pressure alone.

Another object of the present invention is to provide a preprinted duplicating master which can also be used in a spirit duplicating process producing as many copies as conventional despite the use of less dye in the ink.

Other objects and advantages of the invention will be apparent from the following description and the appended claims.

DETAILED DESCRIPTION OF THE INVENTION

The preprinted duplicating masters of the invention achieve the above objects by having reverse printed thereon a resin composition which has a transferable ink composition therein. This allows the masters to be used in either dry duplicating processes or spirit duplicating processes. The resin dispersion is preferably a mixture of vinyl resin and an ink composition. The dispersion is applied to a foundation sheet by printing the mixture of vinyl resin and ink composition in a reverse pattern and subsequently exposing the mixture to sufficient heat or energy to gel (but not fuse) the vinyl resin. The vinyl resin dispersion may be formed by dispersing the vinyl material, polyvinyl chloride, homopolymer or copolymer either alone or with other copolymers in powder form in the dye solvent itself or in a plasticizer to which dye solvent is added. In either event the vinyl resin forms a structure that holds the ink composition therein, but will release a portion of the ink composition in response to the application of the proper amount of pressure or solvent.

In the event the dye solvent itself is to be the dispersion medium, the resin is dispersed as a dry powder directly into the dye solvent. A suitable solvent is oleic acid. The spirit duplicating dye may be added to the dye solvent before or after mixing with the vinyl resin.

In the event the vinyl dispersion is to contain a plasticizer, the plasticizer should be selected so as to be compatible with the synthetic resin. An example of a resin/-plasticizer mixture is equal parts of dioctyl phthalate and Geon 120×241 from B. F. Goodrich Co. (a dispersion grade polyvinyl chloride resin), but other resins and plasticizers can be employed.

When a plasticizer is used, the resin may be dispersed in the liquid plasticizer using a low-speed, high-shear mixer, such as for example, a planetary or internal mixer. The ratio of parts by weight of plasticizer to parts by weight of resin used to make the plastisol may range from ½ to 2. An ink composition comprising spirit duplicating ink dissolved in a solvent such as oleic acid is then added to the plastisol.

Additives also may be incorporated, as needed, to develop the desired properties of the resin dispersions. Examples of typical additives include stabilizers, copolymer resins of larger particle size than the main resin, fillers, pigments, surface active agents, viscosity modifiers and volatile thinners. However the resin dispersion is prepared, the ink composition is preferably releasable from the gelled resin such that the ink will maintain its integrity while being distributed throughout the resin dispersion and thus will exude from the resin structure when pressure is applied thereto.

The ink composition is preferably a solution of a dye in a solvent, with the dye and solvent preferably being premixed using, e.g., a normal speed mixer and some heat to aid the dissolving, to form the ink composition before it is added to the plastisol or mixed with the resin. If the ink is to be able to be used in a spirit duplicating process, in addition to the pressure duplicating process, the ink should be soluble in the solvent or spirit material. If it is to be transferred to a substrate only temporarily, it conveniently should be water soluble so that it can be easily washed off. Normally, the dye will comprise from about 5% to 50% by weight of the ink composition. Although a wide variety of dyes and solvents can be employed, a typical ink composition which can be used in both the spirit and pressure duplicating processes is a 10% solution of crystal violet in an oleic acid solvent.

Other dyes which may be used instead of crystal violet include other spirit soluble dyes such as methyl violet, paper blue, etc. Likewise a number of other dye solvents may be used instead of oleic acid. These include alcohols, glycols, glycerols, polyglycols, and other fatty acids including derivatives of oleic acid.

Usually the ink composition will comprise 30 to 75% by weight of the ink-resin dispersion mixture, with a typical example being 50% by weight of ink composition. It is important that the resin-ink mixture, i.e., the imaging material, contain a sufficient amount of dye to give the number of copies desired, have the rheological properties necessary for preprinting, maintain its viscosity upon aging, and, before gelling, be a homogenous mixture.

The foundation sheet must be able to withstand the gelling temperatures, e.g., 60° C. up to about 175° C. or more, and have little tendency, due to absorption or chemical reaction to change the properties of the imaging material. The foundation sheet also must be such that the resin dispersion, e.g., the vinyl, will remain adhered to the sheet when making copies and only release the releasable ink. The foundation sheet can be a plastic film, metal foil, treated or coated paper, combinations and/or composites of plastic, metal or paper, or the like, material. An example of a suitable foundation sheet is a 3 mil polyester film, such as a polyethylene terephthalate film.

To form the master the ink-resin mixture is printed directly in a reverse printing process on the foundation sheet. Rotogravure, letterpress, stenciling or aniline printing techniques may be used to do the preprinting. Preferably the ink-resin mixture is deposited in a patterned layer between 0.5 and 3 mils thick. The printing is then heated, by hot air or infrared radiation, for example, to between about 120° C. and about 175° C. for about 5 seconds to about 15 seconds to gel the resin in the coating and thereby forming the duplicating master. The printing process can be done as a continuous process or on a batch, sheet-by-sheet basis.

Because the printing is sensitive to pressure, it will be desirable to provide protection against accidental transfer. Preferably a protective cover sheet is applied as part of the printing process. The cover sheet should have little tendency to absorb the releasable ink or any other ingredient of the imaging material, and can be attached by gluing, stapling or the like. An example of a cover sheet is a grease resistant 20 pound basis weight tissue paper. In addition to attaching a cover sheet, the preprinted master may be cut or trimmed to size and/or otherwise processed as is conventional with preprinted masters.

To use the preprinted duplicating masters of the invention, the cover sheet is removed and the printed side of the master is contacted with a substrate which is to receive some of the printing on the master.

In the pressure alone printing process, uniform pressure is applied to the master and the substrate in an amount which is sufficient to cause a portion of the ink composition to exude from the gelled resin dispersion and transferred to the substrate. The pressure contacting of the master and the substrate is repeated until the requisite number of copies are produced. Any type of pressure application means—such as a roller against a flat surface, press, pair of rollers, or even hand pressure such as by burnishing with a blunt instrument may be used. In addition, a spirit duplicating machine, except without using the spirit solution, could be employed. It has also been found that the dwell time in the pressure application can be significant in producing copies having clean, sharp images. The exact amount of pressure and time of application necessary to produce desired number of copies varies, but can be readily determined by trial and error.

The use of the improved masters of the invention in a conventional spirit duplicating process requires no special preparations or apparatus, other than the ink composition being soluble in the spirit material. The spirit material on the surface of the copy sheet will dissolve a portion of the ink composition in the resin material and transfer the ink composition in the predetermined printed pattern to the copy sheet. The resin dispersion itself will not be transferred, and the printing process is continued until the requisite or desired number of copies have been produced.

An example of a formulation of the imaging material, i.e., the ink-resin dispersion mixture, and methods of making and using the duplicating masters of the invention, although the invention is not limited thereto, is as follows:

| Ingredients | Range of Amounts (Parts by Weight) | | Exemplary Amount (Parts by Weight) |
|---|---|---|---|
| Geon 120 × 241 (polyvinyl chloride resin; dispersion grade) | 10 | −20 | 15 |
| dioctyl phthalate | 5 | −40 | 15 |
| crystal violet | .20 | −40 | 3 |
| oleic acid derivative | 4 | −40 | 27 |
| Tribase E (basic lead silicate sulfate) | 0.5 | −3 | 1 |
| viscosity modifier (bentonite clay) | 0 | −1 | .5 |

The Geon (B. F. Goodrich) resin and dioctyl phthalate were placed in a suitable container and mixed using a low-speed, high-shear mixer to form a plastisol. While the vinyl and plasticizer were mixing, the crystal violet and oleic acid derivative were mixed also in a suitable container using heat, but with a normal speed mixer. Once the resin reached the plastisol stage, the Tribase E was added and mixed so that it became thoroughly dispersed therein. Next, the ink composition was added to the plastisol and dispersed throughout, followed by addition of the bentonite clay thixotropic agent to form the printable mixture.

In another example Geon 120×241 (polyvinyl chloride resin) in powder form was dispersed in a methyl violet - oleic acid derivative solution by mixing together in a mixer. No dioctyl phthalate was used. In this instance the ink-resin dispersion mixture is as in the following exemplary amounts (with possible range also given):

| Ingredients | Range of Amounts (Parts by Weight) | | Exemplary Amount (Parts by Weight) |
|---|---|---|---|
| Geon 120 × 241 (polyvinyl chloride resin; dispersion grade) | 10 | −20 | 15 |
| methyl violet | .20 | −40 | 3 |
| oleic acid derivative | 4 | −40 | 27 |
| Tribase E (basic lead silicate sulfate) | 0.5 | −3 | 1 |
| viscosity modifier (bentonite clay) | 0 | −1 | .5 |

Mixtures prepared by both methods were then used to print a predetermined reverse pattern on a 3 mil polyester film sheet to a thickness of 1.5 mil. After printing, the sheet was heated to 130° C. for 10 seconds to gel the resin and to form a duplicating master.

After trimming the sheet to an appropriate size, the master was used in a conventional spirit duplicating machine, except without the use of the spirit duplicating fluid, so that there was only pressure contact between the master and the copy sheets. By the use of pressure alone, 150 copies were made, and each was legible.

While the process and product herein described constitute preferred embodiments of the invention, it is to be understood that the invention is not limited to this precise process and product, and that changes may be made therein without departing from the scope of the invention which is defined in the appended claims.

What is claimed is:

1. A pre-printed duplicating master for producing printed copies with or without spirit duplicating fluids comprising a foundation sheet having a predetermined pattern of imaging material reverse printed directly thereon without the use of a transfer sheet, said imaging material comprising a heat-gelled non-fused vinyl resin having a microporous structure and having dispersed within the microporous structure an ink composition comprising a dye in a solvent, said ink composition being releasable from the microporous structure of said gelled resin and transferable in said predetermined pattern to a substrate on the application of pressure while said gelled resin is retained on said foundation sheet.

2. A master as in claim 1 wherein said releasable ink composition contains a crystal violet or methyl violet dye.

3. A master as in claim 2 wherein said imaging material is present on said foundation sheet in a thickness of between 0.5 mil and 3.0 mils.

* * * * *